US008699306B2

(12) United States Patent
Estrada et al.

(10) Patent No.: US 8,699,306 B2
(45) Date of Patent: Apr. 15, 2014

(54) SILENT ALARM AND EXAM NOTIFICATION TIMER DEVICE

(75) Inventors: Jorge L. Estrada, Glendale, CA (US); Henry K. Chen, La Puente, CA (US); Ever Ynsfran, Los Angeles, CA (US)

(73) Assignee: Gauss Spire LLC, La Puente, CA (US)

( * ) Notice: Subject to any disclaimer, the term of this patent is extended or adjusted under 35 U.S.C. 154(b) by 186 days.

(21) Appl. No.: 13/338,699

(22) Filed: Dec. 28, 2011

(65) Prior Publication Data

US 2013/0170329 A1 Jul. 4, 2013

(51) Int. Cl.
*G04C 21/00* (2006.01)

(52) U.S. Cl.
USPC ..... 368/250; 368/309

(58) Field of Classification Search
USPC ..... 368/244–245, 309–315, 250, 243
See application file for complete search history.

(56) References Cited

U.S. PATENT DOCUMENTS

| | | | | |
|---|---|---|---|---|
| 2,517,368 | A | 8/1950 | Wiseley | |
| 4,093,944 | A | 6/1978 | Muncheryan | |
| 4,630,935 | A | 12/1986 | Zettek | |
| 4,821,247 | A | 4/1989 | Grooms | |
| 4,955,366 | A * | 9/1990 | Uchiyama et al. | 601/4 |
| 5,023,853 | A | 6/1991 | Kawata et al. | |
| 5,144,600 | A | 9/1992 | Cheng | |
| 5,282,181 | A | 1/1994 | Entner et al. | |
| 5,289,452 | A | 2/1994 | Sakamoto et al. | |
| 5,764,594 | A | 6/1998 | Berman et al. | |
| 5,861,797 | A | 1/1999 | Becker | |
| 5,867,105 | A | 2/1999 | Hajel | |
| 5,878,004 | A * | 3/1999 | Miyauchi et al. | 368/230 |
| 6,349,075 | B1 * | 2/2002 | Miyauchi et al. | 368/230 |
| 6,540,396 | B1 * | 4/2003 | Barras | 368/281 |
| 6,724,298 | B2 * | 4/2004 | Smith | 340/407.1 |
| 6,975,563 | B2 | 12/2005 | de Brito | |
| 7,050,360 | B2 * | 5/2006 | Saito | 368/230 |
| 7,898,906 | B2 | 3/2011 | Ishihara et al. | |
| 8,023,361 | B2 * | 9/2011 | Kokuryu | 368/74 |
| 8,059,494 | B2 * | 11/2011 | Veuthey et al. | 368/245 |
| 8,094,522 | B2 * | 1/2012 | Satoh et al. | 368/80 |

(Continued)

FOREIGN PATENT DOCUMENTS

JP 2011-112460 * 6/2011

OTHER PUBLICATIONS

"Examinator", http://www.examinator.com/, de Brito Corporation, 8 pages, printed from the Internet on May 14, 2012.

(Continued)

*Primary Examiner* — Sean Kayes
(74) *Attorney, Agent, or Firm* — Chen Yoshimura LLP

(57) ABSTRACT

A wrist watch-type silent alarm and exam notification timer device includes a vibrator adapted to create a silent vibrating sensation on the skin of the user/wearer, and control circuitry for repeatedly generating silent alarm signals at user-defined time intervals for a user-defined number of times in a programmable manner. The vibrator is disposed inside the timer housing directly on an area of the bottom panel of the housing, and oriented to generate a silent vibration in that area in a direction perpendicular to the bottom panel. The timer device is useful during exam taking to allow the user to keep track of his progress through the exam. Displays are provided to display a total elapsed time of the exam, a lapsed time of the current exam problem, and the number for the current exam problem. Control keys are provided for the user to program the timer.

9 Claims, 8 Drawing Sheets

(56) References Cited

U.S. PATENT DOCUMENTS

| | | | | |
|---|---|---|---|---|
| 2003/0117272 | A1* | 6/2003 | Fegley et al. | 340/309.3 |
| 2004/0008589 | A1 | 1/2004 | McMillan | |
| 2006/0067165 | A1* | 3/2006 | Chan | 368/12 |
| 2007/0183269 | A1* | 8/2007 | Baba | 368/110 |
| 2007/0216537 | A1 | 9/2007 | Park | |
| 2013/0051199 | A1* | 2/2013 | Sakurasawa | 368/276 |
| 2013/0116606 | A1* | 5/2013 | Cordo | 601/46 |

OTHER PUBLICATIONS

"Silent Timer", Silent Technology LLC, http://www.silenttimer.com/testhome/lsat_test.php, 18 pages, printed from the Internet on May 14, 2012.

International Search Report and Written Opinion in counterpart PCT application No. PCT/US2012/071679, dated Mar. 13, 2013.

* cited by examiner

SILENT ALARM AND EXAM NOTIFICATION TIMER DEVICE

BACKGROUND OF THE INVENTION

1. Field of the Invention

The present invention is in the technical field of electronic alarms. More particularly, the present invention is in the technical field of silent electronic alarms.

2. Description of the Related Art

The use of silent electronic alarms is known in the prior art. More specifically, silent electronic alarms heretofore devised and utilized for the purpose of alerting one person without disturbing others are known to consist basically of familiar structural configurations. Devices intended for the deaf to elicit the attention of the user have been known; they tend to be complicated and awkward. In U.S. Pat. No. 2,517,368, Wisely describes a system where a time controlled mechanism is connected to the speaker coils of the hearing aid so that at a predetermine time the speaker coil will induce a tactile sensation in the ear. More recently, U.S. Pat. No. 4,821,247, Grooms describes in-the-ear and on-the-ear alarm devices. Furthermore, U.S. Pat. No. 5,867,105, Hajel discloses a warning system with sensors that detect smoke and transmit the triggering signal to a device worn on the person. Such device must hold the electronics for the receiving unit plus light emitting devices. Such devices alert the user but are bulky, uncomfortable and may fall off the ear rendering the device useless.

Another approach has been a vibratory system that rests under the pillow or near the sleeper. In U.S. Pat. No. 4,093,944, Muncheryan discloses a system for transmitting a recurrent, pulsative motion through the pillow in close proximity to the head of the sleeper and a more refine device is introduce by Chen in U.S. Pat. No. 5,144,600. Clearly such devices are bulky and required prolonged and strong vibrations to be imparted to the sleeper. Such a device produces vibrations throughout the whole bed as to not only wake the user but anyone in the bed and produces audible sounds from the strong vibrations, thus rendering the device useless as a silent alarm and as a system for only alerting one person without disturbing others.

In recent years, miniaturization of electronic parts has spurred the granting of patents of wristwatch configurations. In U.S. Pat. No. 5,289,452, Sakamoto et al. describes an electronic analog timepiece. It includes the plurality of time keeping indicators and the use of integrated circuitry in timekeeping wristwatch. Silent alarm wristwatch soon followed. In U.S. Pub. No. US 2003/0117272 A1, Fegley et al. describe a silent alarm device having a timekeeping mechanism, a wireless data transmitter and a receiving device which is secured to the user. At a predetermined time, a signal is transmitted to the silent alarm device to provide a tactile alarm. There is power saving strategies to increase the life of the battery. Entner et al. introduce a device in U.S. Pat. No. 5,282,181 where a motor having a rotation axis perpendicular to the bottom surface of the watch and bears an eccentric weight to generate a vibration or shaking of the device. In another embodiment of this patent, the bottom surface is a flexible membrane and a protrusion or bump in contact with the bottom membrane is driven to rotate to generate a tactile sensation. Another embodiment of this patent employs a plunger device that delivers a blow to the wearer's arm as the tactile alarm. Clearly this device imparts an awkward sensation to the user by the plunger, and is mechanically complicated and prone to outside atmospheric condition such as water damage.

A similar device is described in U.S. Pub. No. US 2007/0216537 A1, Park describes a wrist watch device coupled through radio signals to an alarm clock and emergency sensors. When activated a radio signal is transmitted to the device worn by the user and an electrical shock is issued to awaken a sleeper along with mechanical vibrations. Such a device makes a user uncomfortable to the idea of being shock, thus making it unsuited for wearing comfortably on the person. In U.S. Pat. No. 5,023,853, Kawata et al. Discloses a device that alerts the user through the use of an ultrasonic wave motor to turn an eccentric weight producing a vibratory sensation throughout the device. By vibrating the whole apparatus an audible sound is produced by the displacement of the eccentric weight inside the device. Berman et al. introduced a battery recharge system in U.S. Pat. No. 5,764,594.

These prior art silent alarms have been less than satisfactory. The energy required for vibrational stimulation is great. There have been some attempts at reducing the amount of energy used by these devices such as battery chargers and specialized circuits to control the amount of energy used, but they lack the effectiveness to produce noticeable results. Furthermore, devices described above that stimulate the skin through electrodes or tactical stimuli give an uncomfortable feeling. Further, there has been very little attempt at reducing the level of sound produced by the vibrating element. In the case of a sleeping or distracted user a silent alarm fail to show effectively that the systems will not draw attention from other especially if a vibrating mechanism is used. Further, the practical applications mentioned in the above-described references are limited to waking a sleeping person, or attracting attention of a person that is impaired such as blind or hard of hearing, or where emergency signals need to be communicated. Very little emphasis been directed to study aids for examination using such devices in the prior art.

SUMMARY OF THE INVENTION

The present invention is directed to a silent alarm and timer device that substantially obviates one or more of the problems due to limitations and disadvantages of the related art.

An object of the present invention is to provide a silent alarm timer device that does not disturb others located in close range by effectively providing tactile stimuli to the user.

Another object of the present invention is to provide such an alarm timer device that is easy to use and can be easily programmed to provide alarm signals repeatedly at predetermine time intervals for a predetermined number of repetitions.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides an alarm timer device which includes: a timer housing having a bottom panel adapted for placing against a user's skin; a vibrator including a motor having a rotor being rotatable around a rotational axis and a weight eccentrically attached to the rotor, the motor being disposed within the timer housing directly in contact with an area of the bottom panel, the rotational axis being parallel to the area of the bottom panel; and control and timing circuitry electrically coupled to the motor for generating a motor control signal at predetermined times and applying the motor control signal to the motor to cause the motor to rotate. The control and timing circuitry is programmable to repeatedly generate an activation signal at a programmed time interval for a programmed number of repetitions.

The alarm timer further includes a plurality of control keys disposed on the timer housing and electrically coupled to the control and timing circuitry, the control keys cooperating with the control and timing circuitry for programming the programmable time interval and the programmable number of repetitions.

The alarm timer further includes a display device electrically coupled to the control and timing circuitry for displaying numerical information, including a first number representing a total elapsed time, a second number representing an elapsed time for a current time interval, and a number representing a current number of repetition, wherein the control and timing circuitry generates update signals for the display device to update the information being displayed.

In another aspect, the present invention provides a method for generating a silent alarm by an alarm timer device, the alarm timer device including a timer housing having a bottom panel adapted for placing against a user's skin and a vibrator, the vibrator including a motor having a rotor being rotatable around a rotational axis and a weight eccentrically attached to the rotor, the motor being disposed within the timer housing directly in contact with an area of the bottom panel, the rotational axis being parallel to the area of the bottom panel, the method including: repeatedly generating an activation signal at a programmed time interval for a programmed number of repetitions; in response to each activation signal, generating a sequence of one or more motor control signals and applying the motor control signals to the vibrator to cause the vibrator to generate a vibration motion; and transmitting the vibration motion through the bottom panel of the housing to a wearer's skin.

The method further has a programming step which includes: receiving first input signals representing the number of repetition; receiving second input signals representing a total time; calculating the time interval by dividing the total time by the number of repetitions.

The sequence of motor control signals includes a first, a second and a third motor control signal, the first motor control signal causing the motor to rotate at a first frequency, the second motor control signal following the first motor control sequence and causing the motor not to rotate, and the third motor control signal following the second motor control signal and causing the motor to rotate at a second frequency which is higher than the first frequency.

It is to be understood that both the foregoing general description and the following detailed description are exemplary and explanatory and are intended to provide further explanation of the invention as claimed.

DETAILED DESCRIPTION OF THE PREFERRED EMBODIMENTS

Figure 1:
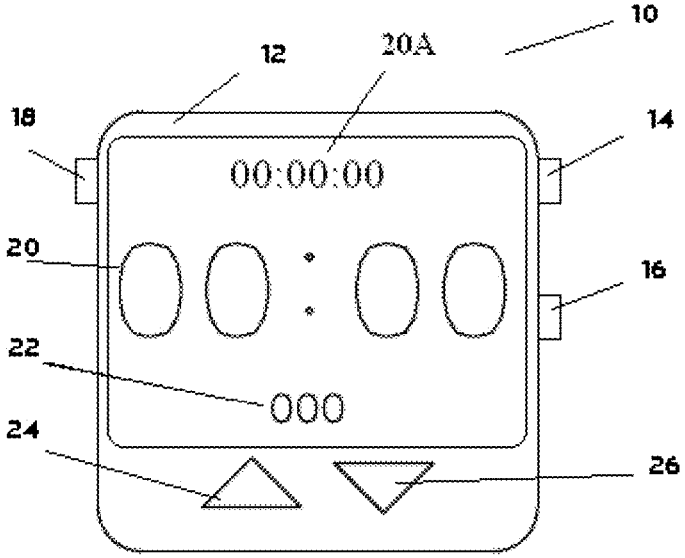
FIG. 1 is a top view of a silent alarm and exam notification timer device according to an embodiment of the present invention.
Figure 2:
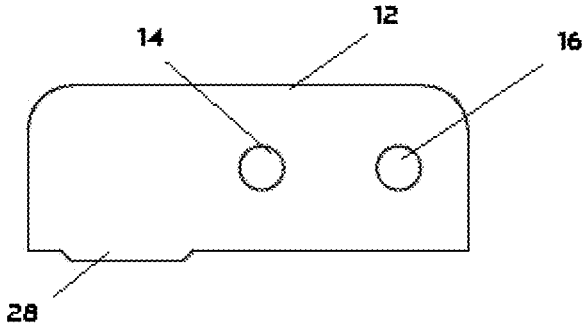
FIG. 2 is a side view of the silent alarm and exam notification timer device.
Figure 3:
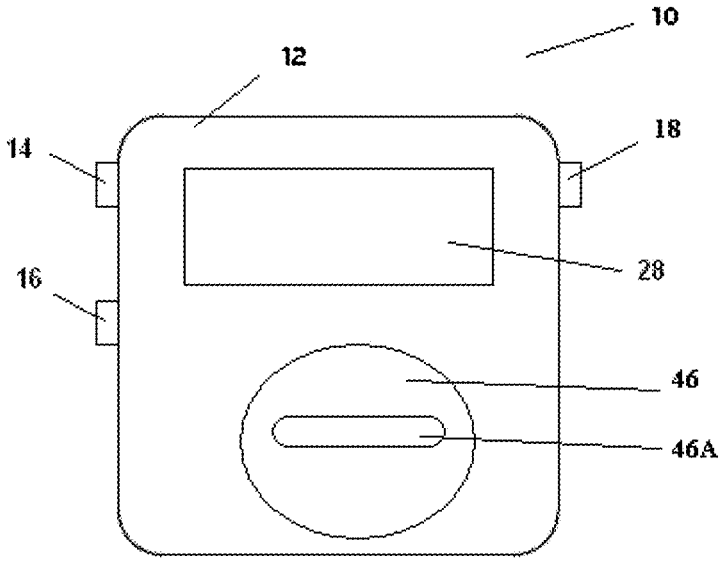
FIG. 3 is a bottom view of the silent alarm and exam notification timer device.

A silent alarm and exam notification timer device according to embodiments of the invention is described in detail with reference to the figures. As shown in FIG. 1 to FIG. 3 (front, side and bottom views, respectively), the silent alarm and exam notification timer device 10 includes a housing 12, one or more displays visible through a front face of the horizontally oriented housing 12, and control keys 14, 16, 18, 24 and 26 for allowing a user to define the predetermined time interval and problem number for purpose of notification as will be described in more detail later. An access point 46 is provided on a bottom panel of the housing 12 to access the interior of the housing 12 (e.g., to change batteries), and a slot 46A is provided on the access port 46 to engage the access point to open it.

The displays may include a time interval display 20, a total time display 20A, and a problem counter display 22, for displaying numerical data representative of an elapsed time for the current exam problem, a total elapsed time since the start of the exam, and the current exam problem, respectively. Some of these displays may be optional The exterior shape of the timer device 10 is sufficiently wide and long for comfortable placement on the wrist, such as about 0.20 to 0.3 inches high, about 1.5 to about 2.3 inches in length and about 1.5 to about 2 inches wide. The control keys 14, 16, 18, 24 and 26 are sufficiently protruded from the housing 12 to be manipulated comfortably, such as about 0.05 to 0.12 inches from the housing 12. These controls keys are each push buttons type switches that allow user to apply an input signal only when they are pushed.

The housing 12 of the timer device 10 may be made of rubber or of any other sufficiently rigid and strong material such as high-strength plastic, metal, and the like, or a combination thereof.

Figure 4:
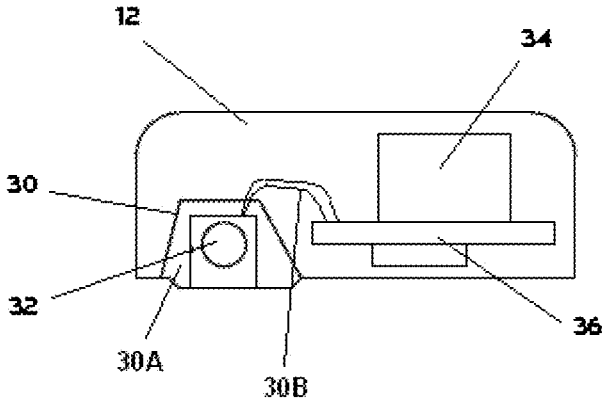
FIG. 4 schematically illustrates an internal structure of the silent alarm and exam notification timer device.
Figure 6:
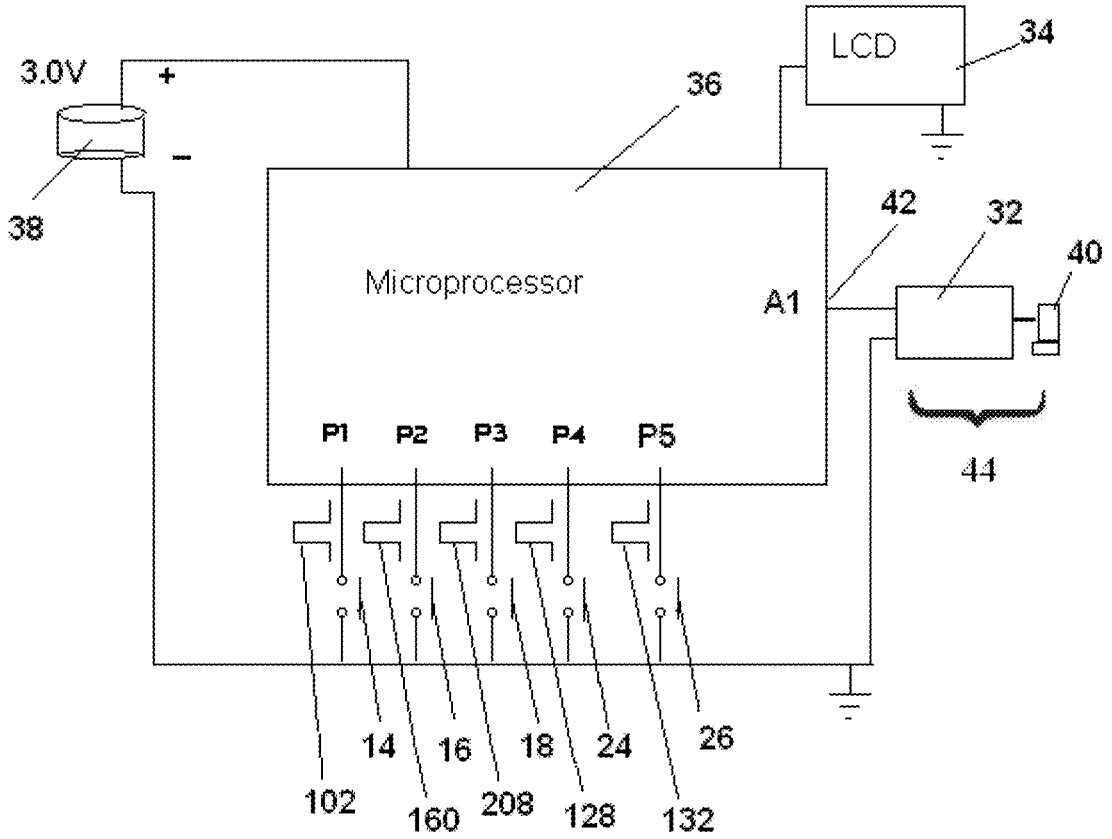
FIG. 6 schematically illustrates various components of the silent alarm and exam notification timer device.

Referring to FIG. 4 and FIG. 6, the silent alarm and exam notification timer device 10 includes a vibrator 44 situated within an interior space of the housing 12. The vibrator 44 includes an electrical motor 32 and a disk-shaped weight 40 eccentrically coupled to a rotor thereof, wherein the vibrator generates a vibrating motion when the motor rotates. In FIG. 6, the vibrator 44 is viewed in a direction perpendicular to the rotational axis of the motor 32. In FIG. 4, the vibrator 44 is viewed in a longitudinal direction parallel to the rotational axis of the motor 32, where the weight 40 is shown as a D-shaped weight in this view. The weight 40 may have other suitable shapes. The exterior shape of the motor 32 as seen in the longitudinal view of FIG. 4 is a square or rectangular shape as defined by an exterior housing of the motor 32; the moving parts of the motor 32 are disposed inside such housing and not visible in FIGS. 4 and 6. The exterior shape of the motor may also be circular or other shape.

In a preferred embodiment, the vibrator 44 is disposed in a vibrator housing 30 located in the interior space of the timer 10; the bottom part of the vibrator housing 30 is formed by an area 28 of the bottom panel of the timer housing 12. In conventional designs, the motor is usually soldered to the main circuit board, so that when its powered not only does the housing but the circuit board also vibrates creating additional noise. In this preferred embodiment of the invention, the motor 32 is directly fixed to the housing and electrical connected to the circuit board via flexible wires 30B thus isolating the circuit board from vibrations. The housing 30 is secured to the bottom of the area, for example, through a latch that snaps on. The space in between the housing 30 and the motor 32 is filled with foam 30A to damp noise. The motor 32 from the manufacturer has a rubber casing to reduce noise. So the bottom of the motor 32 sits directly on the bottom plate of the timer 10 while the space between the rubber casing of the motor 32 and the housing 30 has foam 30A to reduce any noise produced and to ensure that the motor does not "jump" from the bottom plated by exerting a downward push to the motor via the foam.

The vibrator 44 is oriented such that the rotational axis of the motor 32 is parallel to the area 28 of the bottom panel, and the motor 32 is directly placed on (i.e. in direct contact with) the area 28 of the bottom panel. When the motor 32 rotates, the eccentric weight 40 creates a vibration motion of the vibrator 44, the motion being in a plane perpendicular to the rotational axis of the motor 32. Because the rotational axis is parallel to the area 28 of the bottom panel, and because the vibrator 44 is directly placed on this area, the vibration of the vibrator 44 directly impacts the area 28 of the bottom panel, creating an up-and-down (i.e. perpendicular to the bottom panel) vibration motion of the area 28. Because the area 28 is in direct contact with the user's skin when the timer device 10 is worn on the user's wrist, this vibration of the area 28 effectively creates a tactile sensation directly against the user's skin which serves as an alarm to the user.

Further, in a preferred embodiment, as seen in FIG. 2-4, the area 28 of the bottom panel of the timer housing 12 protrudes slightly out relative to other parts of the bottom panel of the timer housing, thus making it more effective to transfer the vibrational stimuli to the user's skin. The size of the protruding area 28 is larger than the size of the part of the vibrator 44 that is placed on the area 28, but is preferably not significantly larger than that. The area 28 may be made of the same material as other parts of the bottom panel, or it may be made of a different material than other parts of the bottom panel. In one embodiment, the area 28 may be made of a separate piece of material and connected to other parts of the bottom panel surrounding the area 28 by a thin band of a softer material to enhance the vibration of the area 28.

The motor 32 may be a commercially available motor, and the weight 40 may be formed integrally with the motor 32 or may be a separate piece securely attached to the motor shaft (rotor). In one particular embodiment, the motor's input voltage is up to 3V, its rotation speed is from 5,000-15,000 RPM, and its noise level is less than 50 dB, preferably less than 45 dB. The noise measurements were done at a distance of 36 inches away. As mentioned earlier, the exterior housing of the motor 32 may be made of rubber, the vibrator 44 may be encased in a vibrator housing 30, such that vibrational amplification inside the timer housing 12 is reduced.

The vibration level generated by the vibrator 44 depends on the level of the drive signal (which may be an analogue voltage) applied to the motor 32. The design and placement of the vibrator 44 described above enhance the effectiveness in generating the tactile sensation on the user, allowing the motor to be driven at a lower voltage than would otherwise be required. In addition to reducing noise level, the lower drive voltage also reduces energy consumption and extends battery life.

Referring again to FIGS. 4 and 6, the timer device 10 further includes a control and timing circuitry 36 (e.g. a microprocessor or microcontroller) adapted to generate control signals for the motor 32, such as an activation signal at predetermined time intervals. The timer device 10 also includes one or more display devices such as liquid crystal display (LCD) 34, which forms the display 20, 20A and 22 visible through the front face. The LCD 34 is electrically coupled to and receives signals from the control and timing circuitry 36. A battery 38 provides power to various components of the timer device 10. For example, the battery 38 includes a pair of contacts to provide power to the control and timing circuitry 36 and the LCD 34. The control keys 14, 16, 18, 24 and 26 are each connected to an input pin of the control and timing circuitry 36, and are push button type switches that allow user to apply an input signal only when they are being pushed.

The control and timing circuitry 36 receives input signals via its pins from the control keys 14, 16, 18, 24 and 26, performs time keeping functions, and generates appropriate signals for the LCD 34 and the motor 32 in a manner described below with reference to FIGS. 5A-5F and FIG. 6. The process described in FIGS. 5A-5F may be implemented by the microcontroller 36 executing software or firmware program code stored in a memory of the timer device 10.

Figure 5A:
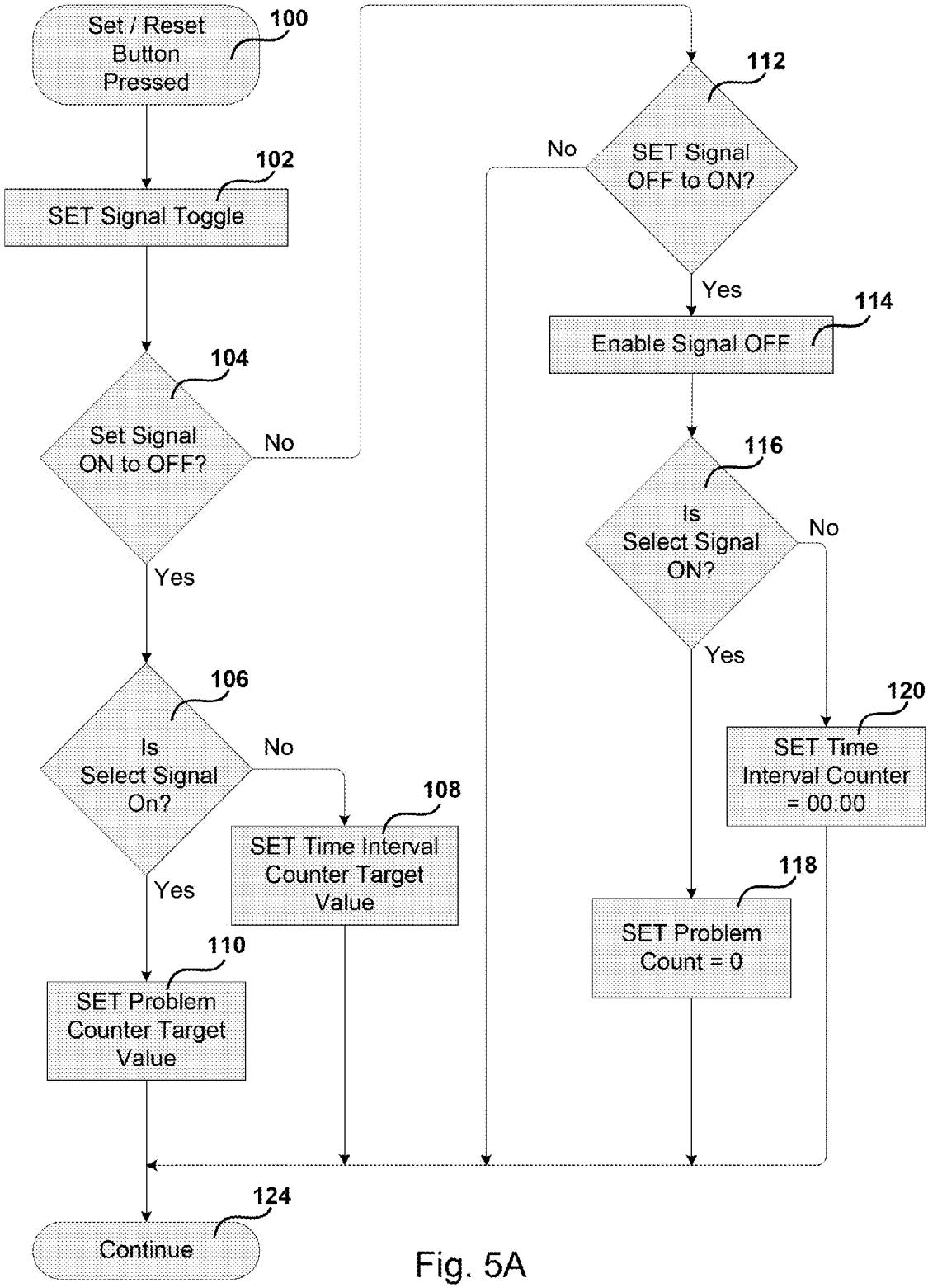
FIGS. 5A to 5F are flowcharts illustrating operations of the silent alarm and exam notification timer device.
Figure 5B:
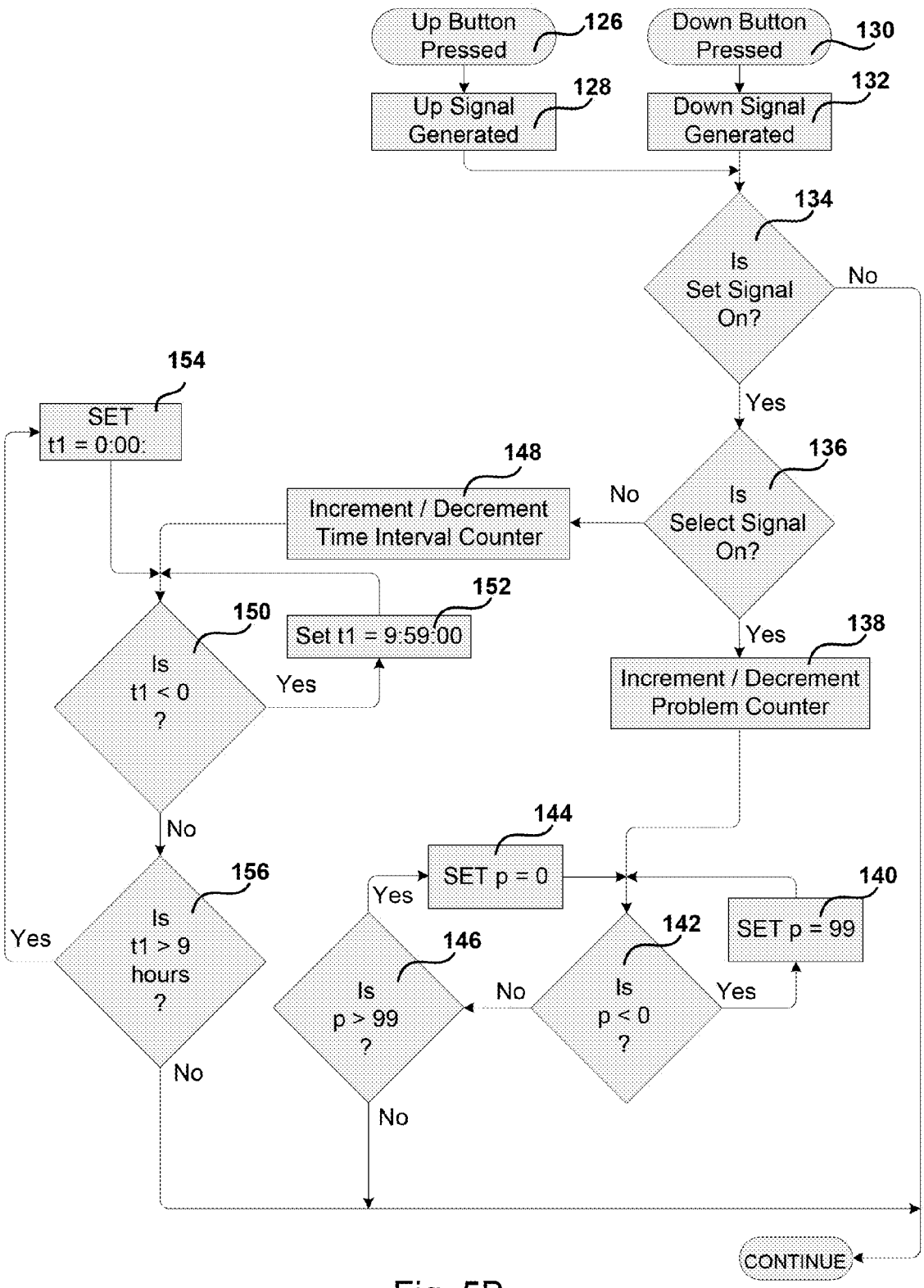
Figure 5F:
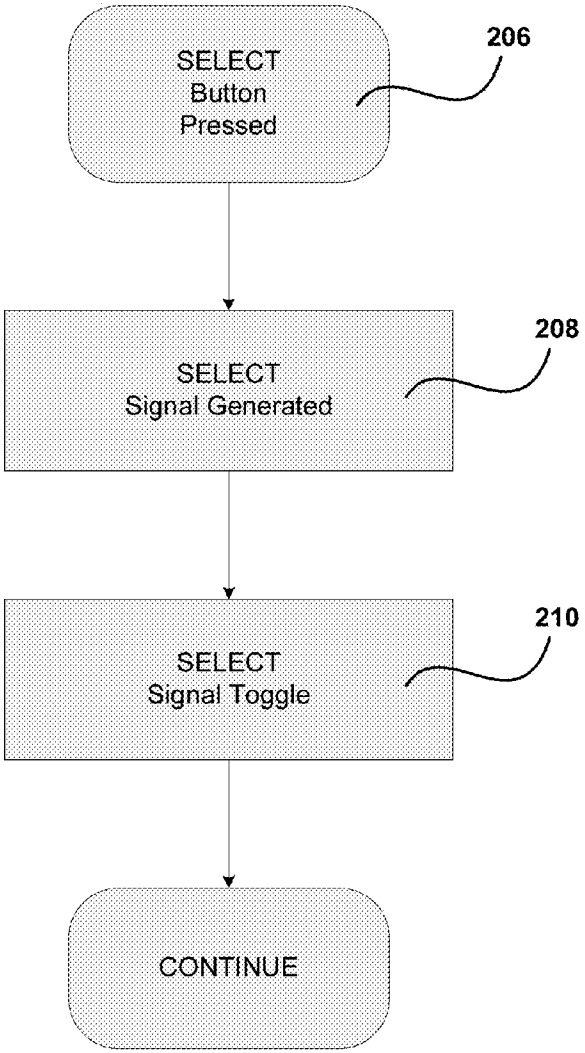

To program the timer device 10, the user uses a SET/RESET key 14, a SELECT key 18 and UP and DOWN keys 24 and 26 to set the problem counter target value and the time interval counter target value (see FIGS. 5F, 5A and 5B). The problem counter target value may represent a total number of problems in an exam. The time interval counter target value may represent a desired time interval allocated to each exam problem. When properly programmed, the timer device 10 will generate an alarm signal at the time intervals defined by the time interval counter target value, and repeat the alarm for a number of times as defined by the problem counter target value.

In reference to FIG. 5F (counter selection), when the control key 18 (SELECT) is pressed (step 206), a SELECT signal is generated (step 208), for example, at input pin P3 of the microcontroller 36 (see FIG. 6). In response, the microcontroller toggles a Select Signal (SelSig) flag from ON to OFF or from OFF to ON (step 210). The microcontroller 36 then waits for additional user input.

In reference to FIG. 5A (set/reset mode), when the control key 14 (SET/RESET) is pressed to generate a SET/RESET signal (step 100), e.g. at input pin P1 (see FIG. 6), the microcontroller 36 toggles a Set Signal (SetSig) flag from OFF to ON or from ON to OFF (step 102). If the SetSig flag is toggle from ON to OFF (step 104), the microcontroller 36 checks if the SelSig flag is ON or OFF (step 106), and either saves the target value (described later with reference to FIG. 5B) as the problem counter target value (step 110) or saves the target value as the time interval counter target value (step 108) depending on the decision in step 106.

If the SetSig flag is toggle from OFF to ON (NO in step 104 and YES in step 112), the Enable Signal (EnaSig) flag is set to OFF (step 114). Note that the EnaSig will enable the counters to keep time when it is ON; in step 114 the EnaSig is turned OFF in order to allow the user to set the time interval and problem counter correctly. In the next step 116, the SelSig is checked to see if it is ON. If it is ON, then the problem counter is set to zero (step 118). If SelSig is OFF, then the time interval counter is set to zero (step 120). Here, zero is used as the initial values of the counters, but other initial values may be used. The process exits the set/reset mode after steps 110, 108, 118 and 120.

In reference to FIG. 5B (programming mode), when the control key 24 (UP) or 26 (DOWN) is pressed (step 126 or step 130), either an up signal or a down signal is generated depending on which key was pressed (step 128 or step 132), for example, at input pins P4 or P5 of the microcontroller 36 (FIG. 6). The next step 134 checks if the SetSig flag is ON; if it is not, the process exits the programming mode. If SetSig is ON in step 134, the next step 136 checks if the SelSig flag is ON. If it is ON, the problem counter target value is incremented or decremented by one depending on whether the signal was generated by the UP or DOWN key (step 138).

The next step 142 checks if the problem counter target value (p) is less than zero. If it is, then set p to ninety-nine (step 140). If not, it checks if p is greater than ninety-nine (step 146). If it is, it sets p to zero (step 144); otherwise the process exits the programming mode. Thus, steps 140, 142, 144 and 146 ensure that the problem counter target value is between 0 and 99. Note that while this is convenient for the user, it is not necessary to limit the problem counter target value between 0 and 99; it can be limited to other values or not limited at all. Thus, steps 140, 142, 144 and 146 are optional.

In step 136, if SelSig is OFF, the time interval counter target value is incremented or decremented by one (meaning one minute in this example) depending on whether the signal was generated by the UP or DOWN key (step 148). The next step 150 checks if the time interval (d) is less than zero. If it is, then set t1 to 9:59:00 (step 152). If not, it checks if t1 is greater than 9:59:00 (step 156). If it is, it sets t1 to zero (step 154), otherwise the process exits the programming mode. Thus, steps 150, 152, 154 and 156 ensure that the time interval counter target value is between 1 minute and 10 hours. Note that while this is convenient for the user, it is not necessary to limit the time interval counter target value to between 1 minute and 10 hours; it can be limited to other values or not limited at all. Thus, steps 150, 152, 154 and 156 are optional.

To summarize, to program the timer device 10, the user first uses the SELECT key 18 to select the problem counter target value or the time interval counter target value to be programmed. The user presses the SET/RESET key 14 until SetSig is toggled to ON, presses the UP and/or DOWN keys 24, 26 to change the target value, and then presses the SET/RESET key 14 again (toggling SetSig to OFF) to set the target value of the selected counter (steps 106 to 110 in FIG. 5A). Note that as shown in FIG. 5B, when SetSig is OFF, the UP/DOWN keys are not effective. If the user presses the SET/RESET key 14 again to toggle SetSig to ON, the initial values of the problem counter or time interval counter are reset to zero (steps 116 to 120 in FIG. 5A).

In one particular operation example, by default the following flags are set when power is first applied to the timer circuit:

Set signal=SetSig=OFF
Select signal=SelSig=OFF
Enable signal=EnaSig=OFF
p=problem counter=10
t1=time interval=1:00
total time displayed 10:00

So, as soon as the user presses the start/stop button is will start the counters. If the start/stop button is pressed again it will stop the counters. If the SET/RESET button is pressed, it will set SetSig to ON and will then clear the counter to 00:00 at step 120. So now the total time display is 00:00 and the time interval time is 0:00. If the user presses the UP button once it will increase the total time to 01:00 and internally the time interval is set to 10 seconds. At this point if the START/STOP is pressed it will activate the counters and the displayed for problems counter and time interval counter will clear to zero.

In the particular example shown in FIGS. 5F, 5A and 5B, the time interval counter target value is set to a value entered by the user. This way, the user may set 1 minute, 1.5 minutes, etc. as the time allowed for each exam problem. In an alternative programming method (not shown), the user may enter the number of problems in the exam and the total exam time (e.g. 30 problems, 60 minutes), and the timer device 10 will calculate the average time interval allowed for each exam problem (by dividing the total exam time by the number of problems) and set the time interval counter target value accordingly. Such an alternative programming method can be implemented by those skilled in the art, based on the descriptions in this disclosure, without undue experimentation.

Figure 5C:
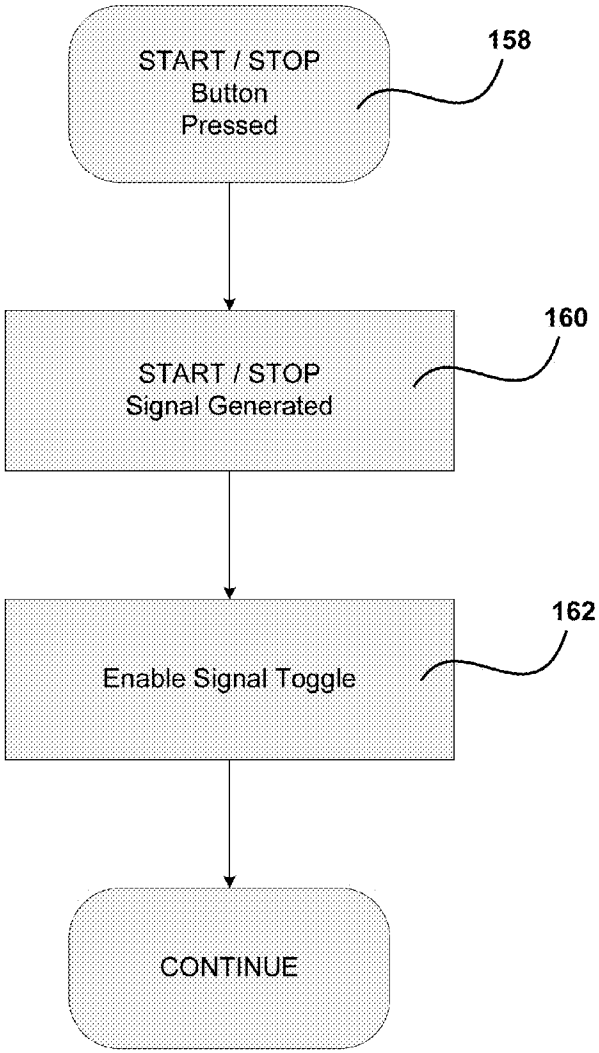

In reference to FIG. 5C (start/stop), when the control key 16 (START/STOP) is pressed (step 158), a START/STOP signal is generated (step 160), e.g., at input pin P2 (see FIG. 6). In response, the Enable Signal (EnaSig) flag is toggled from ON to OFF or from OFF to ON (step 162). The initial condition of EnaSig is OFF when the timer device is not being used (it is also set to OFF in step 114 of FIG. 5A). When EnaSig is ON, the microcontroller 36 is enabled to keep time, and when it is OFF, the microcontroller 36 stops keeping time, as will be described in more detail later. Thus, the START/STOP key functions as a pause key.

Figure 5D:
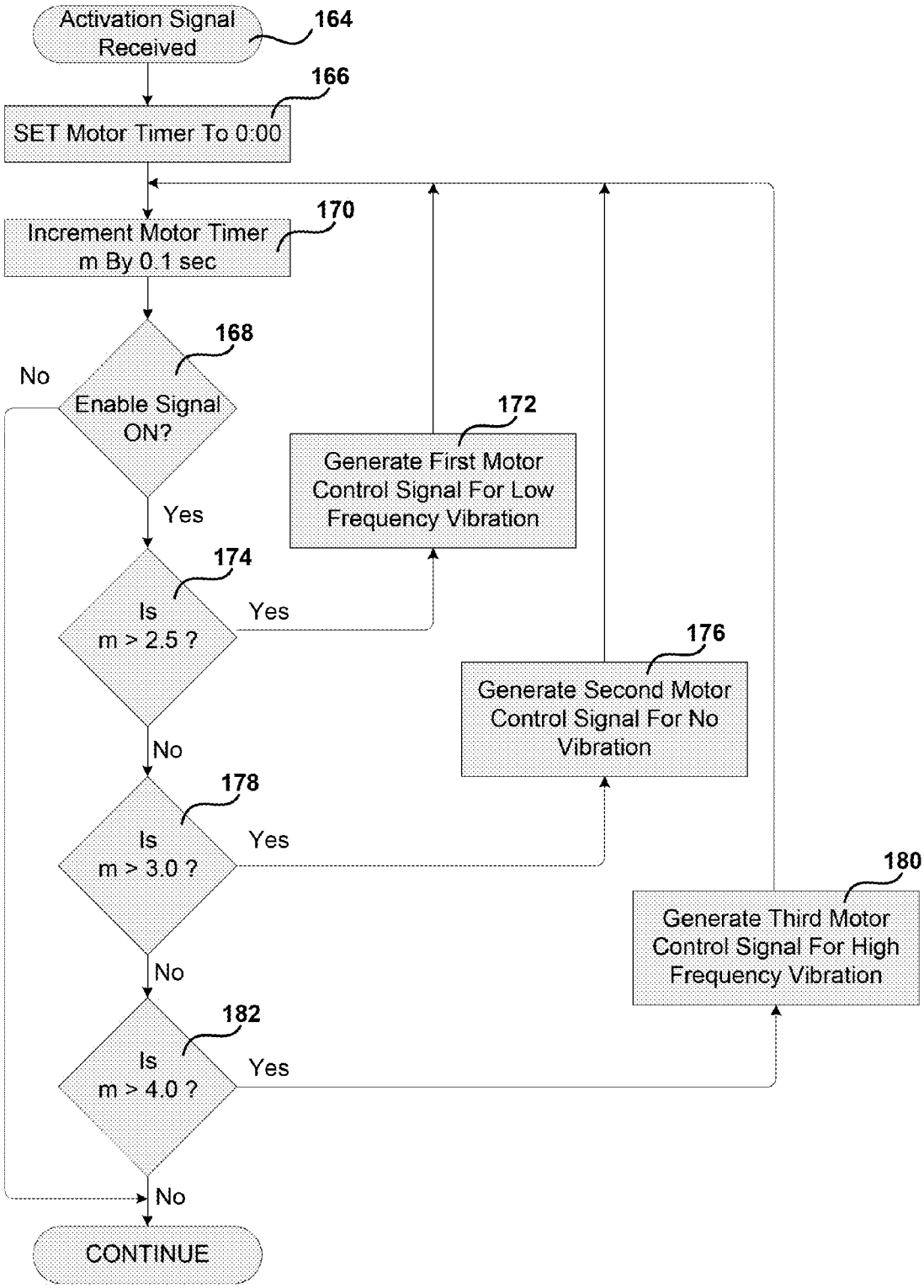
Figure 5E:
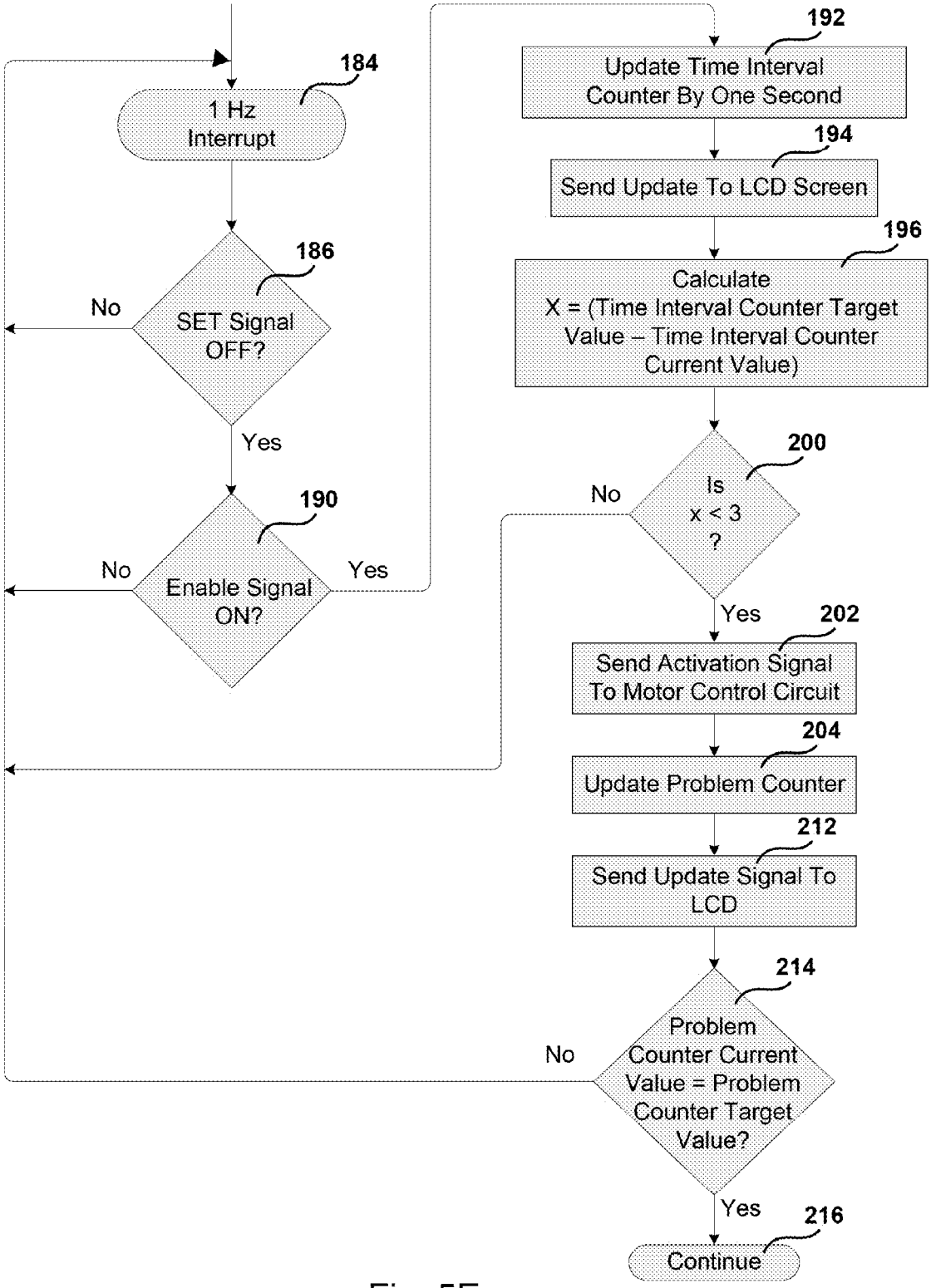

In reference to FIG. 5E (time keeping mode), an internal clock circuitry of the microcontroller 36 produces a 1 Hz interrupt signal every second (step 184). Upon receiving each 1 Hz interrupt signal, the SetSig flag is checked for an OFF condition (step 186). If it is not OFF (NO in step 186), no counter will be updated and the process awaits the next 1 Hz interrupt signal.

If SetSig is OFF (YES in step 186), then the EnaSig flag is checked to see if it is ON (step 190). If EnaSig is ON (YES in step 190), the time interval counter is updated (incremented or decremented) by one second (step 192). In the next step 194, the microcontroller 36 transmits a signal to the LCD 134 to update the timer display 20. The display 20 may display, for example, the time lapse since the start of the current exam problem. If a display 20A for the total elapsed time is implemented, a total elapsed time counter will be implemented in addition to the time interval counter, and it will be updated at this time and the corresponding update signal is transmitted to the LCD 34.

Then, a difference (x) between the time interval counter target value and the time interval counter's current value is calculated (step 196) and compared to a threshold value (3 seconds in this example) (step 200). If x is not less than the threshold value (NO in step 200), no further action will be taken and the process awaits the next 1 Hz interrupt signal. If x is less than the threshold value (YES in step 200), an activation signal is sent to a motor control circuitry which is a part of the microcontroller (step 202).

Next, the problem counter is updated (incremented or decremented) by one (step 204), and the microcontroller 36 sends another signal to the LCD 134 to update the program number display 22 (step 212). The display 22 may display, for example, a number representing the current exam problem that the user should be working on. Then, the problem counter's current value is compared to the problem counter target value (step 214). If they are not equal (NO in step 214), no further action will be taken and the process awaits the next 1 Hz interrupt signal. If they are equal (YES in step 214), the time keeping operation ends.

In step 190, if EnaSig is off (NO in step 190), no counter will be updated and the process awaits the next 1 Hz interrupt signal. As explained earlier, the EnaSig flag may be toggled ON and OFF by the user pressing the START/STOP key 16 at any time. Thus, the process flow of FIG. 5E allows the user to stop (pause) and start (resume) time keeping using the START/STOP key.

Note that in the time keeping process, each of the problem counter and time interval counter may start from a start value and be either incremented or decremented toward an end value, as a matter of design choice. The target values for these counters programmed in FIGS. 5A and 5B represent the difference between the start value and the end value the respective counters. In the particular examples used in FIG. 5E, the time counter target value and problem counter target value are used as the end values (where the start values are zero) and the time counter and problem counter are incremented toward the target values. The invention is not limited to this particular manner of using the counters.

Further, while a 1 Hz interrupt signal is used in the examiner shown in FIG. 5E, interrupt signals having other frequencies may be used.

In reference to FIG. 5D (process of motor control circuit), when the motor control circuit receives the activation signal (step 164), the motor timer is set to 0.0 (step 166). The motor control circuit then checks if EnaSig is OFF (step 168). If it is not OFF (NO in step 168), the motor control circuit determines if the motor timer m is less than a first threshold time value (2.5 seconds in this example) (step 174). If it is (YES in step 174), the motor control circuit generates a first motor control signal to turn on the motor 32 for a low frequency oscillation (step 172). The first motor control signal is an analog voltage applied by the microcontroller 36 to the motor 32 through an output channel 42 (pin A1) of the microcontroller. The voltage of the first motor control signal may be, for example, 2.3V. This voltage is optimized for minimal auditory output; using the motor described earlier, it has been tested that the 2.3V signal generates less than 45 dB auditory output. The motor control circuit continues to apply this first motor control signal for a predefined time interval, such as 0.1 second, and then increments the motor timer by the predefined time interval (0.1 second) (step 170).

Then, the motor control circuit repeats steps 168, 174, 172 and 170; this way, the first motor control signal is continuously applied to the motor 32 (provided that EnaSig is not changed to OFF) until the first threshold time value is reached. When this occurs (NO in step 174), the motor control circuit determines if the motor timer is less than a second threshold time value (3.0 seconds in this example) (step 178). If it is (YES in step 178), the motor control circuit generates a second motor control signal and applies it to the motor 32 via the output channel 42 (step 176). In this example, the second motor control signal is an analog voltage that will not cause the motor 32 to rotate; but the voltage is more than 0V to avoid motor lockup by having low power running through the motor. In one example, the second motor control signal is 1.7V. The motor control circuit continues to apply this second motor control signal for the predefined time interval (0.5 second), and then increments the motor timer by the predefined time interval (step 170).

Then, the motor control circuit repeats steps 168, 174, 178, 176 and 170; this way, the second motor control signal is continuously applied to the motor 32 (provided that EnaSig is not changed to OFF) until the second threshold time value is reached. When this occurs (NO in step 178), the motor control circuit determines if the motor timer is less than a third threshold time value (4.0 seconds in this example) (step 182). If it is (YES in step 182), the motor control circuit generates a third motor control signal and applies it to the motor 32 via the output channel 42 to turn on the motor 32 for a high frequency oscillation (step 180). In this example, the third motor control signal is an analog voltage of 2.5V or higher. This voltage level will generate a vibration at a higher frequency than that generated by the first motor control signal, which will create a stronger tactile sensation for the user. The motor control circuit continues to apply this third motor control signal for the predefined time interval (0.5 second), and then increments the motor timer by the predefined time interval (step 170).

Then, the motor control circuit repeats steps 168, 174, 178, 182, 180 and 170; this way, the third motor control signal is continuously applied to the motor 32 until the third threshold time value is reached. When this occurs (NO in step 182), the motor control circuit no longer applies any motor control signal that causes the motor to vibrate (i.e. the voltage applied on line 42 may be dropped to 0V), and the vibration stops.

During this process, if the EnaSig is determined to be OFF (YES in step 168), the process ends and the motor control circuit no longer applies any motor control signal that causes the motor to vibrate. As described earlier, EnaSig is toggled ON and OFF when the user presses the START/STOP control key 16. Thus, this enables the user to stop the vibration alarm by pressing the START/STOP key 16, for example, after the motor starts the low frequency oscillation.

The process shown in FIG. 5D achieves a variable-level silent alarm. In this particular example, each time the alarm goes off, a vibration sequence is executed which includes a period (e.g. 2.5 seconds) of low frequency vibration followed by a period (e.g. 0.5 second) of no vibration and finally followed by a period (e.g. 1.0 second) of high frequency vibration. This kind of variable-level silent alarm can call the user's attention better than a constant-level silent alarm. Of course, other vibration sequence or time durations may be used for a variable-level silent alarm. A variable-level silent alarm is optional; the silent alarm may also be a constant-level alarm, in which case the process shown FIG. 5D can be omitted, and a single motor control voltage can be applied to the motor 36 for a desired duration after the activation signal is generated in step 202 of FIG. 5E.

The silent alarm and exam notification timer device 10 according to embodiments of the present invention can be used as an exam notification timer device to alert users silently without disturbing others during an exam. The timer device provides many advantageous features.

By providing a display to display the total lapsed time, the elapsed time for the current exam problem (more generally, the elapsed time for the current time interval), and the current exam problem number (more generally, the current repetition of the alarm), the timer device 10 provides a convenient way for the user to keep track of his progress thought an exam or exam preparation.

By implementing the processes described above, the timer device 10 allows the user to conveniently program the timer using control keys to set the total number of exam problems and the time interval allocated to each problem. The timer device 10 then generates a silent alarm at each programmed time interval and repeats the alarm for the programmed number of repetitions. The silent alarm may be variable-level vibration sequence. The timer device further enables the user to stop/start or pause/resume the time keeping, as well as to turn of the motor vibration.

The mechanical design of the timer device 10, including the design and placement of the motor, the mechanical structure surrounding the motor, and the choice of the voltages applied to the motor, leads to a quiet vibrating mechanism. In one design, an overall noise level of lower than 45 dB (measured at 3 feet) was achieved. As a typical quite room has an ambient noise level of 35 dB, such a timer device can be considered a true silent alarm device.

It will be apparent to those skilled in the art that various modification and variations can be made in the silent alarm and exam notification timer device and related method of the present invention without departing from the spirit or scope of the invention. Thus, it is intended that the present invention cover modifications and variations that come within the scope of the appended claims and their equivalents.

What is claimed is:

1. A wristwatch alarm timer device comprising:

a timer housing having a bottom panel adapted for placing against a user's skin;

a vibrator including a motor having a casing and a rotor being rotatable around a rotational axis and a weight eccentrically attached to the rotor, the motor being disposed within the timer housing wherein the casing of the motor is directly in contact with an area of the bottom panel, the rotational axis being parallel to the area of the bottom panel, wherein the area of the bottom panel protrudes out from a remaining portion of the bottom panel;

control and timing circuitry electrically coupled to the motor for generating a motor control signal at predetermined times and applying the motor control signal to the motor to cause the motor to rotate; and the remaining portion of the bottom panel is planar and the bottom panel covers substantially all of a bottom of the wristwatch.

2. The alarm timer of claim 1, further comprising a vibrator housing disposed within the timer housing, wherein the area of the of the bottom panel forms a bottom of the vibrator housing.

3. The alarm timer of claim 1, wherein the area of the bottom panel is made of a material different from another portion of the bottom panel.

4. The alarm timer of claim 1, wherein the timer generates a noise of less than 45 dB measured at 3 feet when the motor is driven at a voltage of less than 3 volts.

5. The alarm timer of claim 1, wherein the control and timing circuitry is programmable to repeatedly generate an activation signal at a programmed time interval for a programmed number of repetitions.

6. The alarm timer of claim 5, wherein in response to each activation signal, the control and timing circuitry generates a sequence of two or more motor control signals and applies the sequence of motor control signals to the motor, wherein the two or more motor control signals are at different levels which cause the motor to rotate at different frequencies.

7. The alarm timer of claim 6, wherein the sequence includes a first, a second and a third motor control signal, the first motor control signal causing the motor to rotate at a first frequency, the second motor control signal following the first motor control sequence and causing the motor not to rotate, and the third motor control signal following the second motor control signal and causing the motor to rotate at a second frequency which is higher than the first frequency.

8. The alarm timer of claim 5, further comprising a plurality of control keys disposed on the timer housing and electrically coupled to the control and timing circuitry, the control keys cooperating with the control and timing circuitry for programming the programmable time interval and the programmable number of repetitions.

9. The alarm timer of claim 1, further comprising a display device electrically coupled to the control and timing circuitry for displaying numerical information, including a first number representing a total elapsed time, a second number representing an elapsed time for a current time interval, and a number representing a current number of repetition, wherein the control and timing circuitry generates update signals for the display device to update the information being displayed.

* * * * *